US005897401A

United States Patent [19]

Fili et al.

[11] Patent Number: 5,897,401

[45] Date of Patent: Apr. 27, 1999

[54] SERRATED STARRED PIN

[75] Inventors: John D. Fili, Fallbrook; Edward Putnam, Murietta, both of Calif.

[73] Assignee: Solid State Stamping, Inc., Temecula, Calif.

[21] Appl. No.: 08/886,601

[22] Filed: Jul. 1, 1997

[51] Int. Cl.[6] ..... H01R 13/40

[52] U.S. Cl. ..... 439/733.1; 411/451

[58] Field of Search ..... 439/733.1, 751, 439/869, 82, 79; 411/451

[56] References Cited

U.S. PATENT DOCUMENTS

| | | | |
|---|---|---|---|
| 66,331 | 7/1867 | Harvey . | |
| 895,080 | 8/1908 | Eisenreich | 411/451 |
| 1,047,802 | 12/1912 | Harding | 411/451 |
| 1,488,948 | 4/1924 | Smith . | |
| 3,670,294 | 6/1972 | Johnson et al. . | |
| 3,827,004 | 7/1974 | Vanden Heuvel et al. . | |
| 3,897,131 | 7/1975 | Stauffer . | |
| 4,057,315 | 11/1977 | Miller et al. . | |
| 4,666,345 | 5/1987 | Seegmiller . | |
| 4,698,026 | 10/1987 | Rolf . | |
| 4,755,091 | 7/1988 | Potucek et al. . | |
| 4,846,655 | 7/1989 | Gulley | 411/453 |
| 4,973,211 | 11/1990 | Potucek | 411/452 |
| 5,030,134 | 7/1991 | Plosser . | |
| 5,035,656 | 7/1991 | Patel | 439/733 |
| 5,318,452 | 6/1994 | Brennian, Jr. et al. | 439/79 |
| 5,487,684 | 1/1996 | Schalk et al. . | |

*Primary Examiner*—Gary Paumen
*Assistant Examiner*—Antoine Nganajui
*Attorney, Agent, or Firm*—Knobbe, Martens, Olson & Bear LLP

[57] ABSTRACT

A contact pin, for insertion into a connector housing, which includes a longitudinal body having a first end and a second end, a retention portion located between the first and second ends, wherein the retention portion includes fins extending outwardly from the longitudinal body, each fin having a side surface and serrations, located on each side surface of each fin.

18 Claims, 5 Drawing Sheets

SERRATED STARRED PIN

FIELD OF THE INVENTION

The invention relates to contact pins which are used to provide mechanical and/or electrical connections between various bodies or structures. More particularly, the invention relates to improvements to starred pins to provide further strength and securing forces with respect to their use in members such as connector housings, header housings and printed circuit boards (PCBs).

BACKGROUND OF THE INVENTION

The invention is described in further detail below with reference to the Figures, wherein like elements are referenced by like numerals throughout.

Electrical contacts, otherwise referred to as terminals or contact pins, are used in the electronics industry in conjunction with printed circuit boards (PCB's), electrical panels, connector cables and other devices, for making electrical connections. As used herein, the terms "electrical" and "electronic", and conjugations thereof, are synonymous and interchangeable, and refer to any component, circuit, device or system which utilizes the principles of electricity in its operation.

A plurality of the contact pins are frequently mounted in an insulative male connector housing, with one end of the contacts extending from the connector housing so as to make mechanical and electrical contact with a female mating connector. In a typical high pin count (HPC) header, for example, which is a commercially available male connector, contacts or wire pins which normally have a circular or square cross section are staked into round holes in a housing. Retention of the pins in the housing is achieved by a press fit, otherwise known as "negative clearance", between the contact pins and the holes of the connector housing. The contact pins are typically made from bronze, brass, steel, stainless steel or copper alloy and the connector housing is typically made from a plastic or resin type material. During the staking process, the holes of the connector housing can become enlarged and deformed due to the negative clearance between the pin and the perimeter of the holes. This degrades the ability of the connector housing to securely hold the contact pins in their proper position and alignment. As used herein, the terms "connector", "header", "housing", and any combination and/or conjugation thereof, are synonymous and interchangeable, and refer to any body, panel, board, device or structure having secured contact pins therein for providing electrical and/or mechanical connections.

It is well known to provide recesses and fins, otherwise known as "stars", on the longitudinal side surface of contact pins to form a retention portion on the contact pins. These star retention portions provide extra holding power when the contact pin is inserted into a connector housing. The recesses and their corresponding fins are formed by stamping technology in which the fins are forced or extruded outwardly as the recesses or grooves are stamped into the retention portion of the contact pin.

Typically, contact pins are formed from square or round wire, or strip metal, made from either steel, stainless steel, bronze, brass or copper alloy. The star feature is a section of the pin that has been expanded by striking the square section, or diameter, of the wire or strip with chisel-like tools on four sides at the same time. This action causes four "V" shaped depressions to be produced in the wire. Between the depressions, a fin is raised above the original diameter or in the case of a square wire, above the diagonal dimension of the wire. Therefore, the star feature is an enlarged portion of the contact pin and is used to provide increased press fit between the contact pin and a hole of a connector housing.

Even with the utilization of these star retention features, however, the connector industry is plagued by defective connectors due to inadequate retention of the contact pins in their connector housings. Many problems occur in connectors due to loose contact pins. These pins may fall out or move partially out of their intended position causing mechanical and/or electrical failure. Past solutions that have been proposed to solve this problem have included increasing the amount of press fit, or negative clearance, between the holes of a connector housing and the contact pins. This is accomplished by making the star feature larger or the hole smaller. However, this approach has not been effective because it has caused cracking or warpage of the connector housing. Similarly, contact headers on PC boards, or the PC boards themselves, have been known to break or crack if a pin, or the star feature of a pin, is too large.

SUMMARY OF THE INVENTION

The present invention addresses the above and other needs by providing serrations, or other types of surface irregularities, along the side walls of the fins of a star retention feature. As used herein, the term "serration" refers to any type of surface irregularity such as bumps, grooves, channels, teeth, ribs, steps, etc., which provides for a non-smooth surface. These serrations provide an improved star or press fit area because they allow a contact pin to be held tighter in a connector housing without increasing the amount of press fit, negative clearance, between the contact pin and the hole. Consequently, the serrations of the present invention significantly reduce the risk of cracking or warpage of the connector housing in which the pin is inserted.

In one embodiment of the present invention, a contact pin includes: a longitudinal body having a first end and a second end; a retention portion located between the first and second ends, wherein the retention portion further includes: a plurality of fms extending outwardly from the longitudinal body, each fin having a side surface; and a plurality of serrations located on each side surface of each fin.

In another embodiment, a contact pin to be inserted into a press fit hole of a connector housing, includes: a longitudinal body having first and second ends; and a retention portion, located on the longitudinal body between the first and second ends, wherein the retention portion includes at least one fin extending outwardly from the longitudinal body, the fin having at least one side surface which is non-smooth.

In a further embodiment, a retention feature for use on a structure with a longitudinal body, includes: a plurality of fins extending outwardly from the longitudinal body, each fin having a side surface; a plurality of channels each formed by adjacent side surfaces of adjacent fins; and a plurality of serrations located on each side surface, wherein each channel receives material of the housing in which the structure is to be inserted and wherein the plurality of serrations on each side surface of the fins provides increased surface contact with the material.

In yet another embodiment, a contact pin for insertion into a connector housing, includes: a longitudinal body having first and second ends; a retention portion, located on the longitudinal body between the first and second ends, the retention portion having at least one v-shaped channel running parallel to the longitudinal axis of the longitudinal body and having two side surfaces which converge to form the v-shape of the channel; and a plurality of serrations located on each side surface of the channel.

The serrations, described above, provide a series of angular shapes which cause the surface of the fins to be non-smooth. This increases the amount of surface area that comes in contact with the plastic or other material of a connector housing. As the contact pin is inserted into a hole of the connector housing the retention feature will initially expand the hole. However, the "memory" or resilience of the material of the connector housing will cause the perimeter of the hole to partially reform or settle back around the area from which it was originally displaced. As the plastic is displaced from its original space, it will settle around the shapes formed by the serrations, thus providing a tighter and stronger hold of the pin in the hole of the connector housing.

Connector pins of all sizes and shapes currently are starred, including round, rectangular and square pins, and the serrations of the present invention can be advantageously placed on any of these types of connectors. Furthermore, another advantage of the present invention is provided in that the serrations are only on the side walls of the fins, rather than on the edge portions of the fins. Because the edges, which make initial contact with the perimeter of a hole, are smooth, the pin may be inserted into the hole of a connector housing with minimal friction or abrasion of the hole of the connector housing and with lower insertion force.

DETAILED DESCRIPTION OF THE PREFERRED EMBODIMENT

Figure 1B:
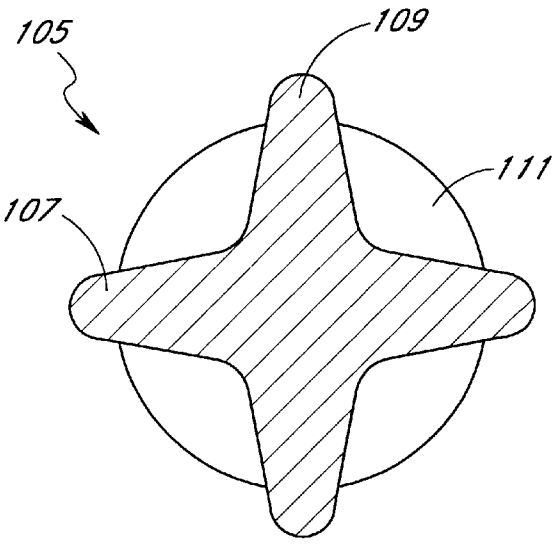
FIG. 1B is a cross-sectional view of the star retention feature of the invention, taken along lines 1B—1B of FIG. 1A.
Figure 1A:
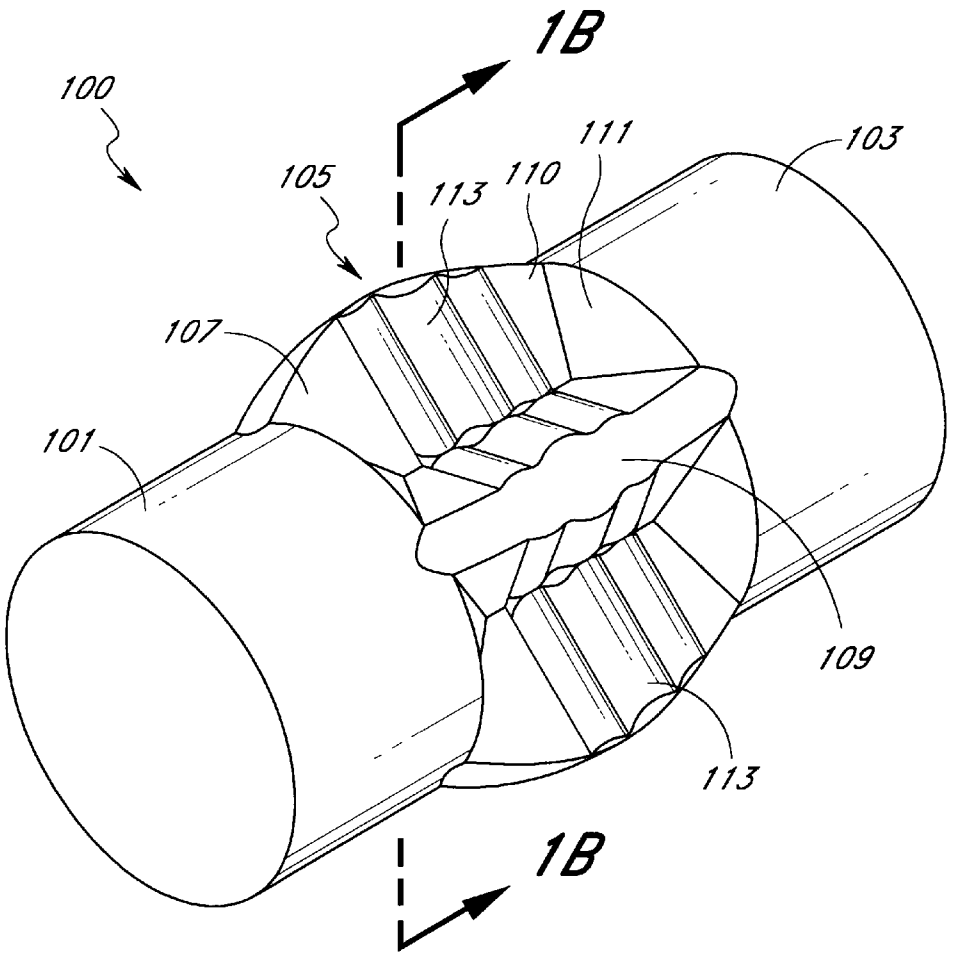
FIG. 1A is a perspective view of a circular contact pin which includes a starred retention feature having serrated fins in accordance with the present invention.

FIG. 1A shows a cylindrical contact pin 100 having a first end 101 and a second end 103. Between the first and second ends 101, 103, is a retention feature 105 for holding the contact pin 100 in a hole of a connector housing (not shown) or a printed circuit board (PCB). The retention feature 105 includes four fins 107 each having a smooth edge surface 109 located between the first and second ends 101 and 103 and two opposing side surfaces 110 which extend radially outwardly from the longitudinal axis of the cylindrical contact pin 100. As can be seen from FIG. 1B, the edge surfaces 109 extend outwardly so as to form an arch between the first and second ends 101 and 103. "V" shaped channels 111 are formed between adjacent side surfaces 110 of the adjacent fins 107. Although the fins 107, the edge surfaces 109 and the channels 111 have been illustrated with specific geometric shapes, it should be understood that modifications of these shapes are contemplated within the scope of the invention described herein, and exemplified by the further non-limiting embodiments described below. These edges 109, channels 111 and fins 107 are formed by stamping technology, which is well-known in the art, and in which the fins 107 are forced or extruded outwardly as the channels 111, are stamped into the retention portion 105 of the circular contact pin 100. This stamping process includes the step of striking the diameter of the cylindrical contact pin 100 with a preformed die pattern which acts like a chisel to deform the diameter of the contact pin into a desired shape. In the embodiment of FIGS. 1A and 1B, cylindrical contact pins are manufactured by striking a round wire, typically made of copper or bronze, on four sides of its diameter at the same time.

In addition to the formation of the fins 107 and their corresponding channels 111, serrations 113 are formed on the sidewalls 110 of the fins 107. These serrations 113 are formed during the stamping process described above. These serrations 113, formed on the side surface 110 of the fins 107, provide a series of angular or rounded shapes which cause the side surface 110 of the fins 107 to be non-smooth. This non-smooth feature increases the amount of surface area that comes in contact with the plastic material of the connector housing or PCB. In addition, the serrations 113 function to "grab" the material of the housing in the press fit area, and increase the frictional force between the material of the housing and the surface areas of the retention feature 105.

As the contact pin 100 is inserted into a hole (not shown) of a connector housing or PCB, the retention feature 105 will initially expand the hole. However, the "memory" or resilience of the material of the connector housing wall, which defines the perimeter of the hole, will cause portions of the wall of the connector that are not forced outwardly by the edges 109 to partially reform or settle back to some extent into the channels 111 of the retention portion 105, thereby making surface contact with the serrations 113 located on the side walls of the fins 107.

In one embodiment, each side surface of each fin 107 includes three serrations 113, in the form of grooves running transversely with respect to the longitudinal axis of the contact pin 100, along the side surface of each fin 107, with the middle groove being deeper than the others. However, it should be understood that the number, shape and size of the serrations may be varied and still remain within the scope of the present invention. It should also be noted that the length of the retention portion 105 on the pin 100, would affect the number of serrations 113.

As mentioned above, the serrations 113 are formed during the stamping process by a progressive die which stamps a wire (round, square or rectangular), or strip metal, to form the desired shape of the retention feature 105. The wire, or strip metal, used may include all grades of bronze, brass, steel, stainless steel, copper alloy or any other material used in a connector to conduct electricity. The progressive die is typically precision made from carbide metal, or other suitable material, which is much harder than the material of the wire or strip metal, such that the die may easily compress and reform the material of the wire or strip into a desired shape. The progressive die is typically made to produce the desired retention feature by means of precision grinding with a diamond wheel. Alternatively, if non-uniform shapes such as bumps or teeth are desired, an electrode may be formed from copper, tungsten or graphite. The shape of the electrode may then be burned into the carbide metal die by means of an electrical discharge machine (EDM). This type of burn-in process is well-known in the art.

Figure 2B:
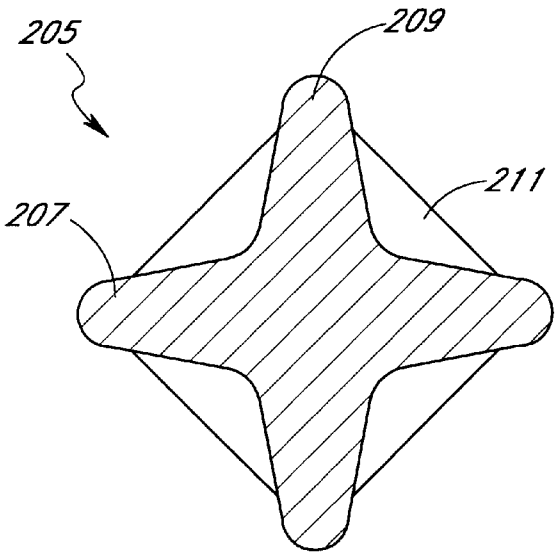
FIG. 2B is a cross-sectional view of the star retention feature of the invention, taken along the lines 2B—2B of FIG. 2A.
Figure 2A:
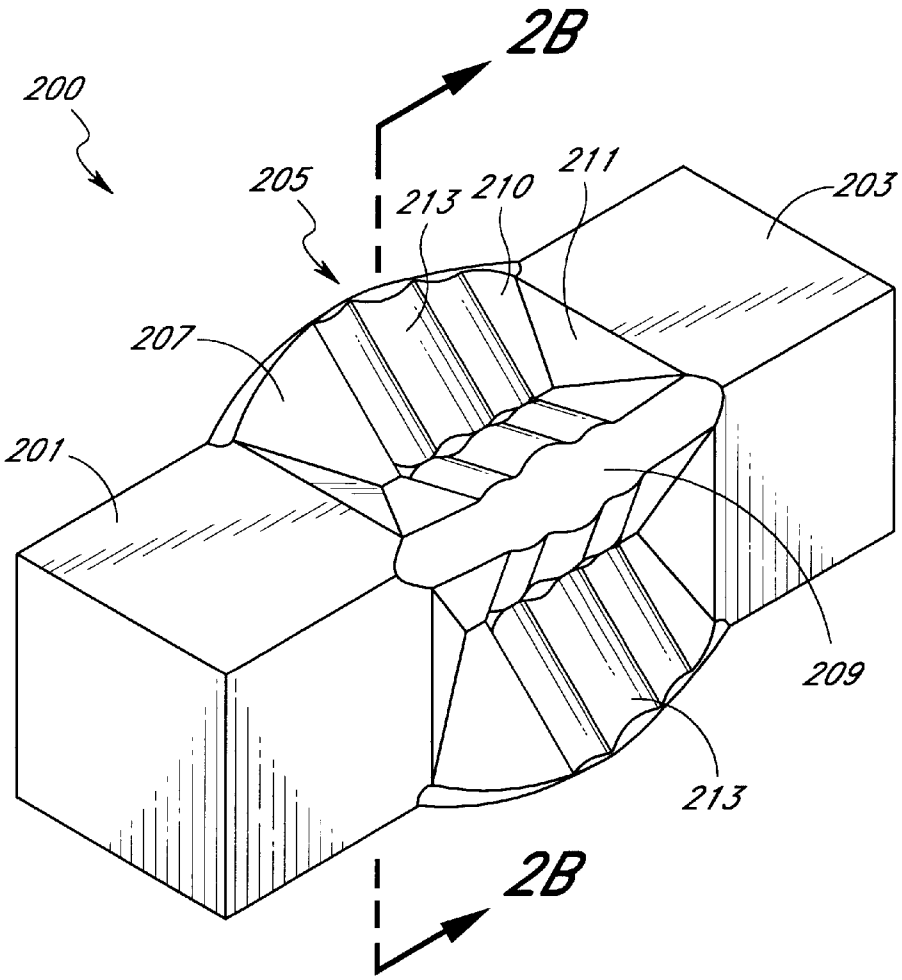
FIG. 2A is a perspective view of a square contact pin which includes a star retention feature having serrated fins in accordance with the present invention.

FIG. 2A shows a contact pin 200 which has been formed from a square wire. The contact pin 200 has a first end 201 and a second end 203 with a retention feature 205 therebetween. As described above with respect to FIGS. 1A and 1B, the retention feature 205 of FIG. 2A includes four fins 207 forming channels 211 between adjacent fins 207. The fins 207 each have a smooth edge surface 209 which the edge surfaces 209 make initial contact with the perimeter of a hole (not shown) of a connector housing in which it is to be inserted. The fins 207 each further include two opposing side surfaces 210 which extend racially outwardly from the longitudinal axis of the contact pin 200. The fins 207 also include serrations 213 located on the opposing side surfaces 210 of each fin 207.

FIG. 2B shows a cross section of the retention feature 205 of the contact pin 200 taken along lines 2B—2B of FIG. 2A. The retention feature 205 is formed by stamping or striking each of the four sides of the square wire, thereby forming the channels 211. As the material is compressed inwardly during the stamping process to form the channels 211, a fin 207 is raised along each corner of the square wire.

As the contact pin 200 is inserted into a hole (not shown) of a connector housing or PCB, the retention feature 205 will initially expand the hole. However, the "memory" or resilience of the material of the connector housing wall, which defines the perimeter of the hole, will cause portions of the wall of the connector 200 that are not forced outwardly by the edge surfaces 109 to reform or settle back to some extent into the channels 211 of the retention portion 205, thereby making surface contact with the serrations 213 located on the side walls of the fins 207.

Figure 3B:
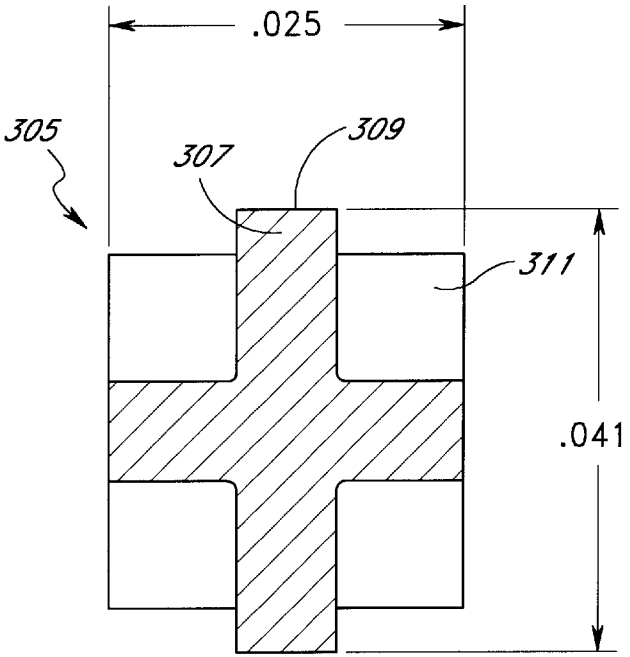
FIG. 3B is a cross-sectional view of the retention feature of the invention, taken along lines 3B—3B of FIG. 3A.
Figure 3A:
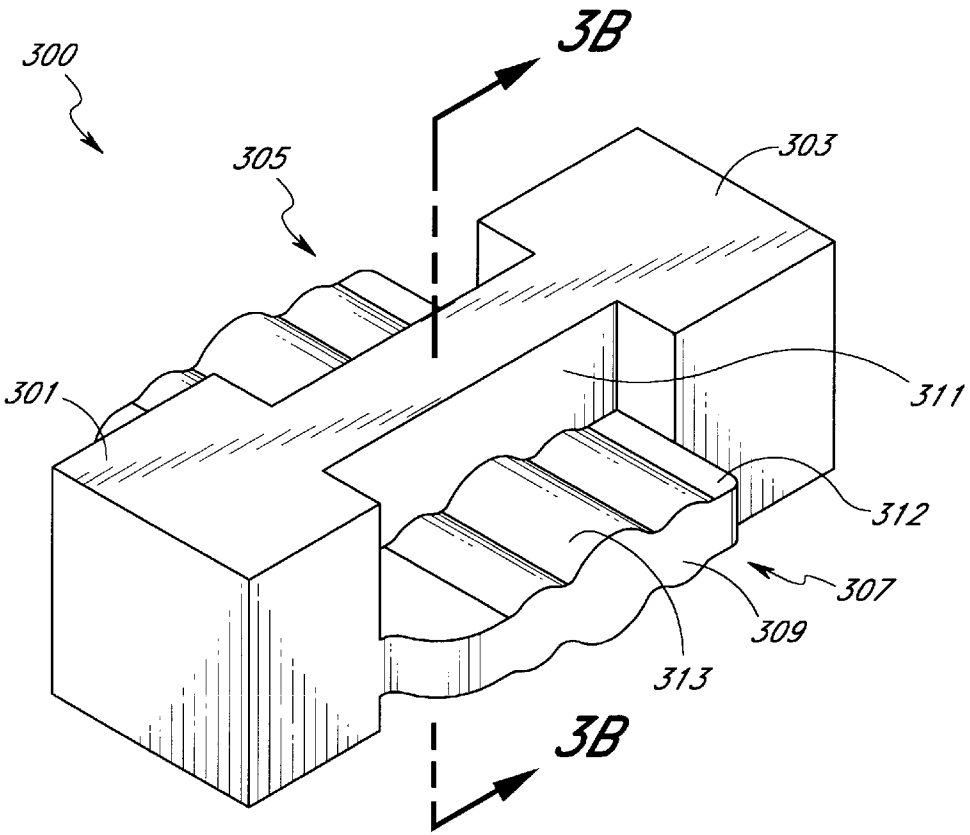
FIG. 3A is a perspective view of a square contact pin which includes another type of retention feature having serrated fins, in accordance with the present invention.

As exemplified in FIG. 3A, the serrations of the present invention can be advantageously placed on connector pins of all sizes and shapes. FIG. 3A shows a contact pin 300 formed from a square or rectangular wire, or strip metal, and having a first end 301 and a second end 303. Between the first and second ends, 301, 303, a retention feature 305 is stamped which includes two fins 307 each having an edge surface 309 which makes initial contact with the perimeter of a hole (not shown) of a connector housing. Each fin 307 has opposing side surfaces 312 which extend outwardly from the contact pin 300. Serrations 313 are formed on each side surface 312 of each fin 307. During the stamping process which forms the fins 307, channels or recesses 311, as well as side surfaces 312 and the serrations 313 on the side surfaces 312, are formed.

FIG. 3B shows a cross sectional view of the retention feature 305 having fins 307 and channels 311. As can be seen from FIG. 3B, the distance from the edge 309 of one fin to the edge 309 of another fin is approximately 0.041 inches, while the distance of one side of the square contact pin is approximately 0.025 inches. These dimensions are shown merely for the purpose of exemplifying the relative sizes of the retention portion and the remaining portions of the contact pin, and should not be construed as limiting the scope of the present invention. In addition, it should be readily apparent to one of ordinary skill in the art, that the size and shape of the fins and the serrations 313 themselves are not limited to those described and shown in the figures above to obtain the advantages of the present invention. For example, the serrations 313 may be replaced by "bumps" or teeth dispersed on each side surface of each fin 307. By providing these serrations, bumps, teeth, grooves and other surface irregularities on the side surfaces of the fins of a star retention feature, the present invention provides increased gripping surface area which contacts the material of a connector housing, thereby providing added retention force between each pin and the connector housing.

It should be noted, however, that the serrations, grooves and other types of surface deformities are not present on the edges 109 (FIG. 1A), 209 (FIG. 2A), 309 (FIG. 3A) of the fins 107, 207, 307, respectively. Because the edges of the fins are smooth, the respective contact pin may be inserted into a hole of a connector housing with minimal friction or abrasion which can cause damage to the housing material which defines the hole and reduce the retention force provided by the resilience or "memory" of the housing material. Therefore, the stamping process which forms the contact pins in accordance with the present invention, is careful to form the serrations, or other types of surface deformations, only on the side surfaces of the fins of a retention portion, rather than on their edges.

Figure 4B:
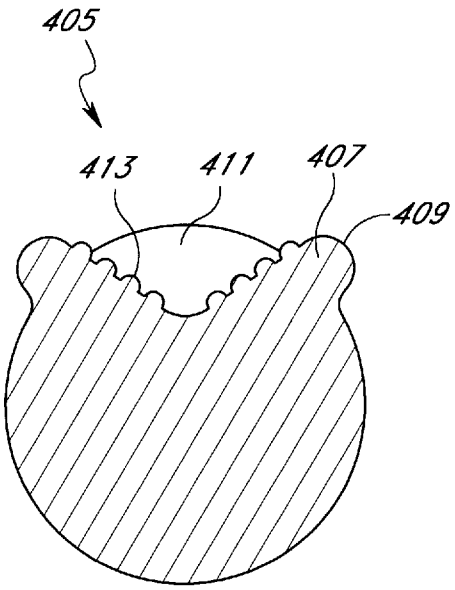
FIG. 4B is a cross-sectional view of the retention portion of the contact pin of the invention, taken along lines 4B—4B of FIG. 4A.
Figure 4A:
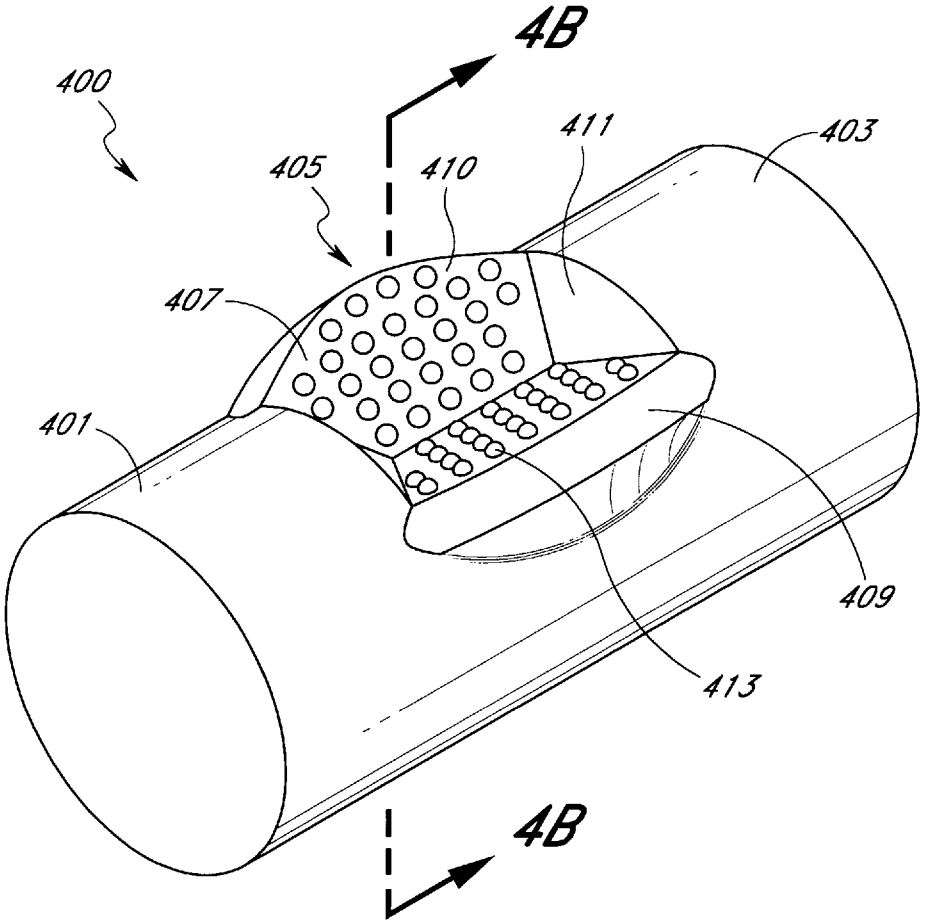
FIG. 4A is a perspective view of a circular contact pin which includes a retention portion having a v-shaped channel and bumps located on the side surfaces of the v-shaped channel, in accordance with the present invention.

Referring to FIG. 4A, a cylindrical contact pin 400 includes a first end 401 and a second end 403. Located between the first and second ends 401, 403, is a retention feature 405 having two fins 407. Each fin 407 includes an edge surface 409 and a side surface 410 which extends radially outwardly from the cylindrical contact pin 400. The two-side surfaces 410 converge with each other to form a V-shaped channel 411. Dispersed on each of the side surfaces 410 are serrations 413 in the form of bumps 413. These bumps 413 provide increased surface area which contacts the material of a connector housing when the contact pin 400 is inserted into a hole of the connector housing. FIG. 4B shows a cross-sectional view of the retention feature 405 of FIG. 4A which includes the two fins 407, a V-shaped channel 411 formed between the two fins 407 and bumps 413 formed on each side surface 410 of the fins 407.

When the contact pin 400 is inserted into a hole (not shown) of a connector housing, the retention feature 405 will initially expand the hole as it meets the edge surfaces 409 of the fins 407. However, the "memory" or resilience of the material of the connector housing wall, which defines the perimeter of the hole, will cause portions of the wall of the connector 400 that are not forced outwardly by the edge surfaces 409 to partially reform or settle back, to some extent, into the channel 411 of the retention feature 405, thereby making surface contact with the bumps 413 located on the side surfaces of the fins 107.

Figure 5B:
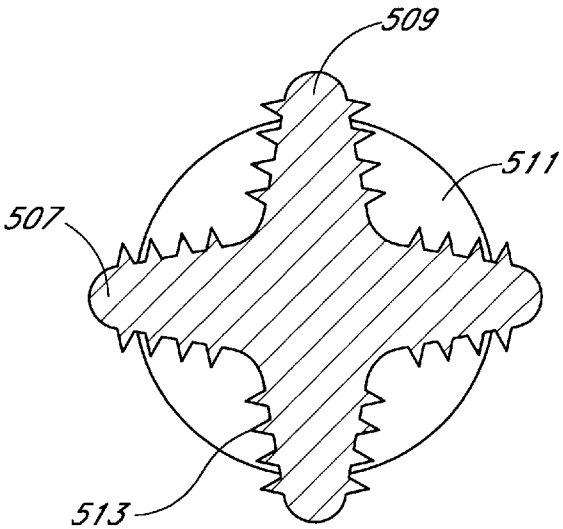
FIG. 5B is a cross-sectional view of the star retention feature of the invention, taken along lines 5B—5B of FIG. 5A.
Figure 5A:
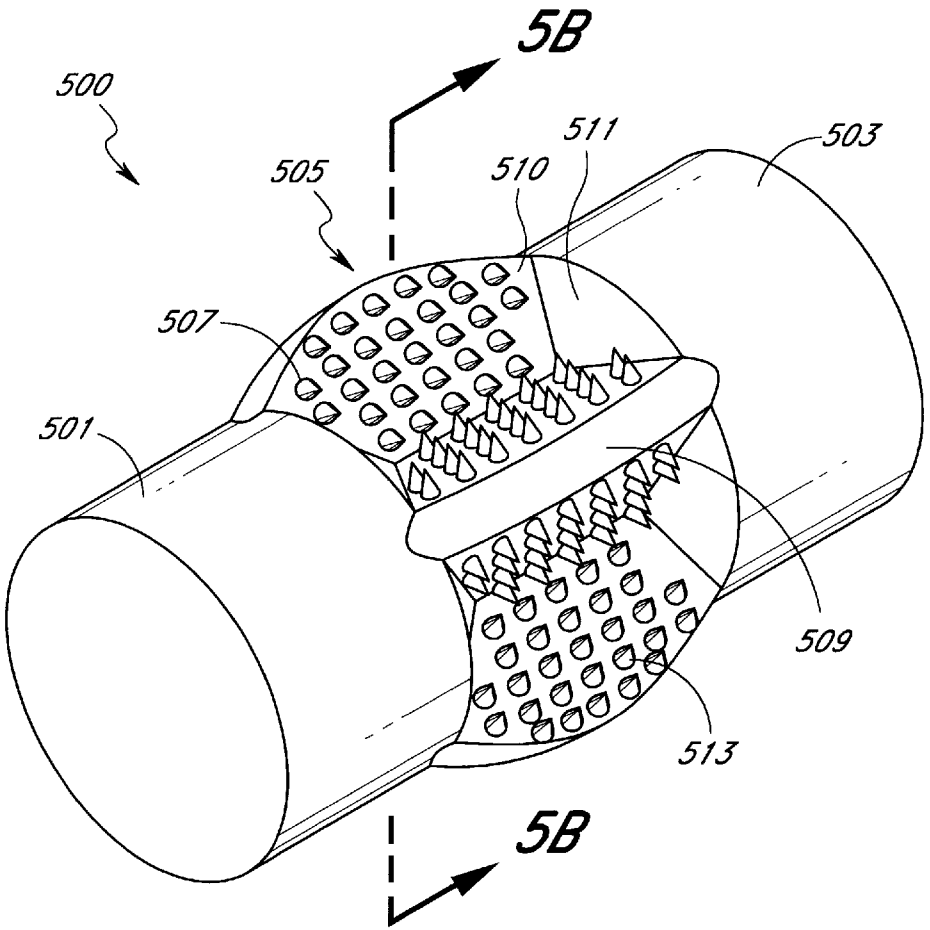
FIG. 5A is perspective view of a circular contact pin which includes a star retention feature having four fins and teeth located on each side surface of each fin, in accordance with the present invention.

FIG. 5A shows another embodiment of the present invention in which a circular contact pin 500 has a first end 501 and a second end 503. Between the first and second ends 501, 503, is a star retention feature 505 having four fins 507. Each fin 507 has a edge surface 509, which extends outwardly so as to form an arch between the first and second ends 501 and 503, and two opposing side walls 510 extending radially outwardly from the longitudinal axis of the cylindrical contact pin 500. Adjacent side walls 510 of adjacent fins 507 converge to form a v-shaped channel 511. On each side wall 510 a plurality of teeth extrude outwardly. These teeth 513, not only provide increased surface area to make contact with the material of a connector housing, but also provide the function of "grabbing" the material of the connector housing by increasing the frictional force between the retention portion 505 and the material of the connector housing.

FIG. 5B shows a cross-sectional view of the retention portion 505 of FIG. 5A. As shown in FIG. 5B, the retention portion 505 includes four fins 507 each having an edge surface 509 and two opposing side walls 510. Between adjacent side walls 510 of adjacent fins 507 a V-shaped channel 511 is formed. On each side wall 510 of each fin 507, a plurality of teeth 513 extend outwardly in order to make contact with the material of a connector housing which is pressed into the channel 511. As the contact pin 500 is inserted into a hole (not shown) of a connector housing, the retention feature 505 will initially expand the hole. However, the memory or resilience of the material of the connector housing will cause portions of the wall, which defines the hole that are not forced outwardly by the edge surface 409 to reform or settle back into the channels 511 of the retention portion 505, thereby making surface contact with the teeth 513 located on the side walls 510 of the fins 507.

Preliminary testing has indicated that a typical contact pin having a star retention feature without serrations, requires approximately 5.43125 pounds of force to push the pin out of a typical plastic connector housing, while a similar contact pin having a star retention feature with serrations, in accordance with the present invention, requires approximately 7.7875 pounds of force to push the pin out of the plastic connector housing. Therefore, these tests indicate almost a 50% increase in the amount of force required to push a pin, having serrations on the fins of its star retention feature, out of a plastic connector housing.

This increase in retention force allows a smaller star to be coined on the contact pin which will provide a push out resistance at least equal to a larger non-serrated star. Thus, the serrated starred pin, of the present invention, provides a smaller star retention feature which reduces the amount of cracking or deformation of the plastic connector housing. As should be apparent, another benefit of a smaller starred retention feature is that it allows for a tighter configuration of pins in a connector housing. Furthermore, since the smaller starred pin reduces cracking and deformation of the plastic of a connector housing, the use of lower quality, or less costly, types of plastic may be used when making the connector housings.

While the invention disclosed herein has been described by means of specific embodiments and applications thereof, numerous modifications and variations could be made thereto by those skilled in the art without departing from the scope of the invention as set forth in the claims.

What is claimed is:

1. A contact pin used in providing a connection within a connection within a deformable component, comprising:

a longitudinal body having a first end and a second end;

a retention portion located between the first and second ends, wherein the retention portion comprises:

a plurality of fins extending outwardly from and longitudinally along the longitudinal body, each fin having a side surface and each fin defining a substantially continuous, uninterrupted outer edge along the retention portion; and a plurality of serrations extending over a substantial portion of at least one side surface of at least one fin, the serrations being substantially sepatated from the side surfaces of adjacent fins;

wherein the serrations and the fins cooperate to deform at least a portion of the component in proximity to the side surface such that the contact pinis maintained in a fixed position relative to the deformable component by the force of the deformed portion of the component against the side surface and the serrations.

2. The contact pin of claim 1, wherein the retention feature comprises a star shape having four fins extending outwardly from the longitudinal body.

3. The contact pin of claim 1, wherein said longitudinal body is of cylindrical shape.

4. The contact pin of claim 1, wherein a cross section of said longitudinal body is of a square shape.

5. The contact pin of claim 1, wherein a cross section of the longitudinal body is of a rectangular shape.

6. The contact pin of claim 1, wherein said plurality of serrations comprise at least three grooves, wherein a middle groove is deeper than the other grooves of the at least three grooves.

7. A contact pin configured to be inserted into a press fit hole of a connector housing, comprising:

a longitudinal body having first and second ends; and a retention portion, located on the longitudinal body between the first and second ends, wherein the retention portion includes at least one fin extending outwardly from and longitudinally along the longitudinal body, the fin having at least one side surface which is non-smooth over a substantial portion thereof, the fin further defining a substantially continuous, uninterrupted outer edge from one end thereof to the other;

and further wherein the at least one fin and its at least one non-smooth side surface cooperate to deform at least a portion of the connector housing in proximity to the at least one side surface such that the contact pin is maintained in a fixed position relative to the connector housing by the force of th deformed portion of the connector housing against the non-smooth side surface.

8. The contact pin of claim 7, wherein said non-smooth surface is formed by providing a plurality of grooves on the side surface of the fin.

9. The contact pin of claim 7, wherein the non-smooth side surface is formed by providing a plurality of bumps on the side surface.

10. The contact pin of claim 7, wherein the non-smooth side surface is formed by providing a plurality of teeth on the side surface.

11. A retention feature for use on a structure with a longitudinal body, comprising:

a plurality of fins extending outwardly from and longitudinally along the longitudinal body, each fin having a side surface and defining a substantially continuous, uninterrupted outer edge from one end thereof to the other;

a plurality of channels each formed by adjacent side surfaces of adjacent fins; and a plurality of serrations located on each side surface, wherein the plurality of serrations on each side surface provide increased surface contact with the material of housing in which the structure is to be inserted, and wherein the serrations and fins cooperate to deform at least a portion of the material in proximity to the side surface such that the contact pin is maintained in a fixed position relative to the housing by the force of the deformed portion of the material against the side surface.

12. The retention feature of claim 11, wherein the plurality of fins comprises four fins extending outwardly from the longitudinal body to form a star configuration.

13. The retention feature of claim 11, wherein the serrations comprise a plurality of bumps to provide a non-smooth surface on each side surface of each fin.

14. The retention feature of claim 11, wherein the serrations comprise a plurality of teeth on each side surface of each fin.

15. The retention feature of claim 11, wherein the structure is a contact pin to be inserted into a connector housing.

16. A contact pin for insertion into a connector housing, comprising:

a longitudinal body having first and second ends;

an expanded retention portion, located on the longitudinal body between the first and second ends, the retention portion having at least one v-shaped channel running parallel to the longitudinal axis of the longitudinal body and having two side surfaces which converge to form the v-shaped channel; and a plurality of serrations located on each side surface of the channel, said serrations located on one side surface being physically separate from those located on the opposite side surface, wherein the serrations and the at least one v-shaped channel cooperate to deform at least a portion of the connector housing in proximity to the side surfaces such that the contact pin is maintained in a fixed position relative to the connector housing by the force of the deformed portion of the housing against the side surfaces and their respective serrations.

17. The contact pin of claim 16, wherein the serrations comprise a plurality of bumps located on each side surface of the channel.

18. The contact pin of claim 16, wherein the serrations comprise a plurality of teeth located on each side surface of the channel.

* * * * *